United States Patent [19]

Shibuya et al.

[11] Patent Number: 4,766,947

[45] Date of Patent: Aug. 30, 1988

[54] METHOD AND APPARATUS FOR PRODUCING RAPIDLY SOLIDIFIED MICROCRYSTALLINE METALLIC TAPES

[75] Inventors: Kiyoshi Shibuya; Fumio Kogiku; Michiharu Ozawa, all of Chiba, Japan

[73] Assignee: Kawasaki Steel Corporation, Kobe, Japan

[21] Appl. No.: 9,564

[22] Filed: Jan. 30, 1987

Related U.S. Application Data

[63] Continuation of Ser. No. 783,217, Oct. 2, 1985, abandoned.

[30] Foreign Application Priority Data

Oct. 9, 1984 [JP] Japan ..... 59-210340

[51] Int. Cl.[4] ..... B22D 11/126; B22D 11/06

[52] U.S. Cl. ..... 164/460; 164/463; 164/476; 29/527.6; 29/527.7; 72/85

[58] Field of Search ..... 72/85; 164/476, 76.1, 164/463, 483, 484, 454, 423, 441, 154, 460; 29/527.7, 527.6; 148/2

[56] References Cited

U.S. PATENT DOCUMENTS

| | | | |
|---|---|---|---|
| 2,233,578 | 3/1941 | Boak | 164/460 |
| 2,752,648 | 7/1956 | Robert | 164/460 |
| 3,147,521 | 9/1964 | Boehm | 164/460 |
| 3,293,692 | 12/1966 | Rosenbaum | 164/460 |
| 4,316,497 | 2/1982 | Wakefield et al. | 164/483 |
| 4,323,419 | 4/1982 | Wakefield | 164/463 |
| 4,341,260 | 7/1982 | Ishibachi et al. | 164/463 |
| 4,518,029 | 5/1985 | Shibuya et al. | 164/463 |
| 4,703,791 | 11/1987 | Sakaguchi et al. | 164/417 |

FOREIGN PATENT DOCUMENTS

| | | | |
|---|---|---|---|
| 3609811 | 10/1986 | Fed. Rep. of Germany | 164/476 |
| 1198006 | 12/1959 | France . | |
| 75861 | 7/1980 | Japan | 164/460 |
| 156655 | 12/1980 | Japan | 164/463 |
| 1206 | 1/1981 | Japan | 29/527.7 |
| 4348 | 1/1981 | Japan | 164/463 |
| 165543 | 12/1981 | Japan | 164/480 |
| 15219 | 3/1983 | Japan | 164/480 |
| 118360 | 7/1985 | Japan | 164/460 |
| 85/01901 | 9/1985 | PCT Int'l Appl. . | |

*Primary Examiner*—Nicholas P. Godici
*Assistant Examiner*—Samuel M. Heinrich
*Attorney, Agent, or Firm*—Balogh, Osann, Kramer, Dvorak, Genova & Traub

[57] ABSTRACT

A method and apparatus for producing a rapidly solidified microcrystalline metallic tape. The method provides for molten metal to be continuously poured through a nozzle onto surfaces of cooling members to form a rapidly solidified metallic tape and then coiling the tape on a reel. According to this method, the metallic tape is secondarily cooled and rolled before the coiling. The apparatus includes a device for cutting out a non-steadly portion of the metallic tape, a device for measuring tape thickness, a secondary cooling member, and a device for controlling the tension of the metallic tape.

5 Claims, 5 Drawing Sheets

METHOD AND APPARATUS FOR PRODUCING RAPIDLY SOLIDIFIED MICROCRYSTALLINE METALLIC TAPES

This application is a continuation of application Ser. No. 783,217, filed Oct. 2, 1985, now abandoned.

BACKGROUND OF THE INVENTION

1. Field of the Invention

This invention relates to a method of producing rapidly solidified metallic tapes, particularly rapidly solidified microcrystalline metallic tapes.

Throughout the specification, there are proposed developmental results with respect to the fact that a rapidly solidified metallic tape of about 0.1 to 0.6 mm in thickness is formed in a good form by pouring molten metal downward onto a surface of a cooling member rotating at a high speed and then coiled.

2. Related Art Statement

In general, rapidly solidified amorphous metallic tapes are already cooled to about 150°-200° C. at a position just close to a cooling roll apart thereform. Such a cooled state is also a condition for the production of amorphous metallic tape.

On the other hand, in the production of microcrystalline metallic tapes, since it is generally intended to obtain a relatively thick tape, the tape temperature of about 1000° C. is still held at the position just close to the cooling roll apart therefrom while releasing latent heat of solidification. Therefore, it is necessary to arrange a cooling zone behind the cooling roll. In this case, it is very difficult to cool and coil a metallic tape of about 0.35 mm in thickness, which is formed by passing through the cooling rolls at a high speed under a high temperature state without breaking, through the cooling zone without the deterioration of the form.

SUMMARY OF THE INVENTION

It is an object of the invention to provide a method of adequately coiling a rapidly solidified microcrystalline metallic tape with a good form and an apparatus for practicing this method.

According to a first aspect of the invention, there is the provision of a method of producing a rapidly solidified microcrystalline metallic tape by continuously pouring molten metal through a nozzle onto surfaces of a pair of cooling members rotating at a high speed to rapidly solidify it and then coiling the resulting rapidly solidified metallic tape, characterized in that the metallic tape transported from the cooling members is cooled and rolled before the coiling after a non-steady portion at at least an initial production stage is cut out from the metallic tape.

In the preferred embodiment of the invention, the travelling line speed of the metallic tape is decreased at the initial production stage and, if necessary, last production stage in the cutting of non-steady portion, and increased at the remaining steady stage. Further, the pouring rate of molten metal is controlled based on an output signal from a meter for measuring tape thickness in a control circuit for the supply of molten metal. And also, the rolling before the coiling of the cooled metallic tape is a different speed rolling, and the cooling of the metallic tape is carried out with a gas or a mist (fog). Moreover, the tension of the metallic tape is separately controlled at low tension and high tension.

According to a second aspect of the invention, there is the provision of an apparatus for producing a rapidly solidified microcrystalline metallic tape by continuously pouring molten metal through a nozzle onto surfaces of a pair of cooling members rotating at a high speed to rapidly solidify it and then coiling the resulting rapidly solidified metallic tape, comprising a means for cutting out a non-steady portion of the metallic tape travelled from the cooling members, a means for measuring a thickness of the metallic tape, a cooling means for the metallic tape, and a means for controlling a tension of the metallic tape.

DETAILED DESCRIPTION OF THE INVENTION

Figure 1:
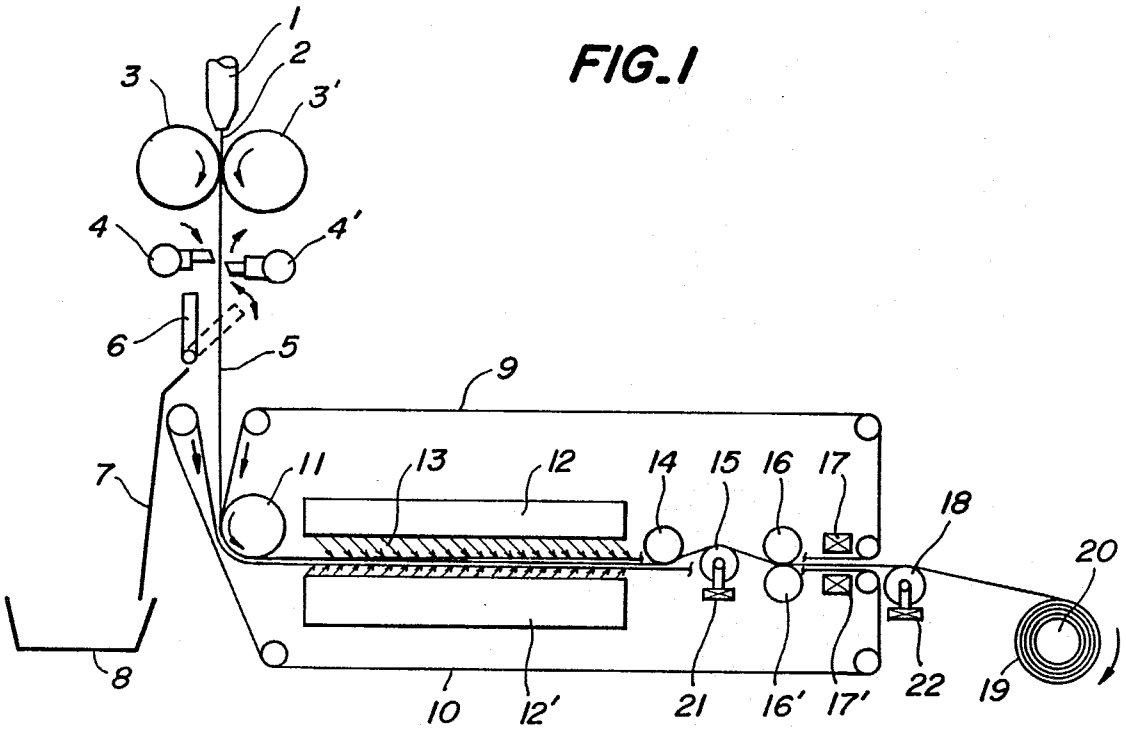
FIG. 1 is a skeleton view illustrating the production line for rapidly solidified microcrystalline metallic tapes according to the invention.

Referring to FIG. 1, numeral 1 is a pouring nozzle, numeral 2 a flow molten metal (hereinafter referred to as a melt flow), numerals 3, 3' twin-type cooling rolls as a cooling member rotating at a high speed, numerals 4, 4' a pair of shear members, numeral 5 a metallic tape, numeral 6 a change-over gate, numeral 7 a chute, numeral 8 a bag, numeral 9 a pair of upper travelling members, numeral 10 a pair of lower travelling members, each of numerals 11, 14, 15 and 18 a deflector roll, numerals 12, 12' cooling headers, numeral 13 an air or mist flow, numerals 16, 16' a pair of pinch rolls, numeral 17 a thickness meter, numeral 19 a coil, numeral 20 a reel, numerals 21 and 22 front and rear region tension meters.

As seen from FIG. 1, the melt flow 2 tapped from the pouring nozzle 1 is rapidly solidified between the cooling rolls 3 and 3' to form the metallic tape 5.

At the initial production stage or initial solidification stage, a normal metallic tape can not be obtained because the amount of the melt flow 2 and the amount of the melt in the kissing region defined between the cooling rolls 3 and 3' are non-steady. In this connection, the similar result may be caused at the last production stage or last pouring stage. For this reason, it is difficult to coil such a non-steady tape portion itself different from the case of coiling the normal or steady tape portion and also the normal metallic tape is damaged by the coiled non-steady tape portion.

Therefore, the non-steady tape portion is cut as a crop by using the shear members 4, 4' and the change-over gate 6, which is dropped into the bag 8 through the chute 7.

After the crop cutting at the position of the shear members 4, 4', a tip of the normal or steady tape portion descending downward from the cooling rolls 3, 3' is first caught by a pair of plural clampers (not shown), one of which clampers is arranged on the upper surface of the upper or lower travelling member 9 or 10, near the deflector roll 11 by the driving of the travelling members 9 and 10 and then travelled with the movement of the travelling members 9 and 10 toward the reel 20 and finally coiled therearound to form the coil 19. In this case, the deflector roll 14 and the pinch roll 16 rise and the deflector roll 15 and the pinch roll 16' descend only in the passing of the clampers so as not to obstruct the passing of the clampers, while these rolls turn back to original positions immediately after the passing of the clampers. When the tip of the metallic tape is separated from the travelling members for coiling, the clampers are moved up to the predetermined position, respectively, to stop the movement of the travelling members. As the reel 20, use may preferably be made of a carrousel reel.

The effects based on the fact that non-steady portions at the initial and last production stages are cut out from the metallic tape left from the cooling rolls 3, 3' at high temperature are shown in the following Table 1.

TABLE 1

| Cutting | Failure*1 ratio of sledding | Ratio*2 of poor coiling form | Damage*3 ratio of coiled tape |
|---|---|---|---|
| performed | 0% | 0% | 2% |
| not performed | 17% | 13% | 15% |

The meanings of the above evaluation items will be described below.

*1Failure ratio of sledding:
At the initial and last production stages, undesirable phenomena such as breakage of non-steady tape portion in the travelling, defection from the production line due to the jetting and the like or so-called initial poor coiling occur in the coiling. Therefore, the failure ratio of sledding causing such phenomena is defined as follows:

$$\text{Failure ratio of sledding} = \frac{\text{failure number of sleddings}}{\text{number of sleddings}} \times 100(\%)$$

*2Ratio of poor coiling form:
The poor coiling form such as telescope or the like is judged by an operator, which is quantitatively represented by the following equation:

$$\text{Ratio of poor coiling form} = \frac{\text{number of poor coils}}{\text{number of coils}} \times 100(\%)$$

*3Damage ratio of coiled tape:
The inside of the coiled tape is damaged by the poor coiled portion, which is transferred to the upper coiled layer one after another. Such a damaged portion is quantitatively represented by the following equation:

$$\text{Damage ratio of coiled tape} = \frac{\text{coiling number of damaged portion}}{\text{total coiling number}} \times 100(\%)$$

At the time of initial and last travelling as well as coiling, low-speed operation is favorable in view of the fact that the solidification state of the metallic tape is non-steady as well as the mechanical capacities of the shear members 4, 4', the travelling members 9, 10 and the coiling machine 20. On the other hand, it is usually necessary to make the travelling speed higher in view of the aimed tape thickness and the productivity. This travelling speed is, of course, determined by the pouring rate, solidification speed and peripheral speed of the cooling roll.

Taking the above into consideration, it has been concluded that the best operation is a speed-increasing and decreasing operation wherein only the initial and last travelling stages are performed at a low speed and the other remaining stage is performed at a steady pouring speed or a high speed.

In the production of the metallic tape, the effects based on the fact that low speed operation is performed at the time of cutting the non-steady tape portion at the initial and last stages are shown in the following Table 2.

TABLE 2

| Operation condition | Ratio of bad tape*1 tip form after cutting | Ratio of entwining*2 occurrence in sledding |
|---|---|---|
| low speed (3 m/sec) | 2% | 0% |
| high speed (7 m/sec) | 23% | 85% |

The meanings of the above evaluation term will be described below:

*1Ratio of bad tape tip form after cutting:
After the cutting of the non-steady portion, the sledding and coiling are performed. In this case, the good or bad form of the tape tip after the cutting largely exerts on the result of the subsequent operation. Therefore, the good or bad form based on the operator's judgement is quantitatively defined by the following equation:

$$\text{Ratio of bad form} = \frac{\text{bad cutting number}}{\text{cutting number}} \times 100(\%)$$

Figure 2:
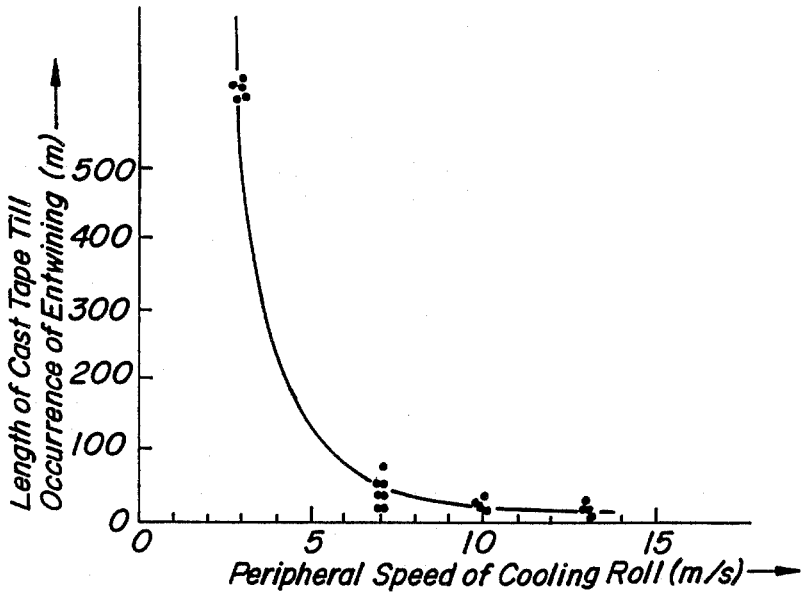
FIG. 2 is a graph showing a dependency of the sledding on the peripheral speed of cooling roll.

*2Ratio of entwining occurrence in sledding:
The relation between the peripheral speed of the cooling roll and the length of cast tape till the occurrence of entwining is determined from the graph shown in FIG. 2. It is understood from FIG. 2 that the entwining is apt to extremely occur as the peripheral speed of the cooling roll becomes increased. Moreover, the data of FIG. 2 are obtained when a tension is not applied to the cast tape.
Since the cast tape is not substantially subjected to a tension in the sledding, the tension control is first made possible after the initial coiling. Therefore, the entwining in the sledding results in the failure of sledding. The ratio of entwining occurrence is quantitatively calculated by the following equation, provided that the sledding length is 20 m:

$$\text{Ratio of entwining occurrence} = \frac{\text{entwining number}}{\text{sledding number}} \times 100(\%)$$

Even when the travelling speed is increased or decreased after or before the cutting at the initial or last stage, in order to prevent the tape breakage, tape damage and the like due to the deficient or excessive pouring rate as far as possible, it is necessary to control the peripheral speed of the cooling roll and the pouring rate by an output signal from the tape thickness meters 17, 17' arranged on the production line.

Of course, the same control as described above is carried out even in the steady operation at a predetermined pouring rate in order to prevent the change of the tape thickness.

Figure 3:
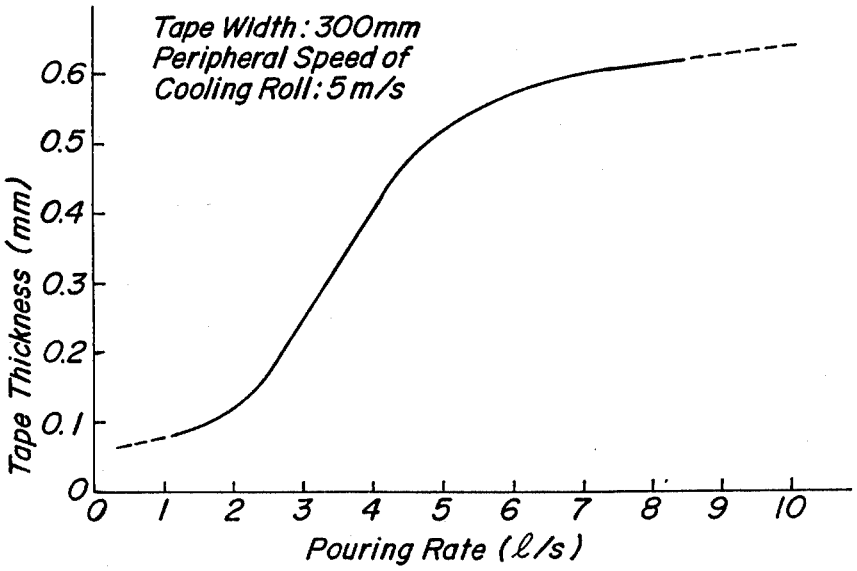
FIG. 3 is a graph showing a relation between the pouring rate and the tape thickness.

The relation between the tape thickness and the pouring rate is shown in FIG. 3. As apparent from FIG. 3, there is a substantially linear relation between the tape thickness and the pouring rate when the tape thickness is within a range of 0.15–0.5 mm, but when the tape thickness is outside the above range, it is difficult to make the tape thick or thin. Based on this linear relation between the tape thickness and the pouring rate, the change of the pouring rate at a given peripheral speed of the cooling roll is carried out by means of a control circuit as mentioned later in accordance with a deviation between the set value of tape thickness and the measured value from the tape thickness meter.

In general, when cooling the high temperature metallic tape, the rapid cooling results in the tape deformation, while the slow cooling brings about the fracture of solidification texture due to restoring heat and the increase of equipment cost due to the extension of the cooling zone.

Therefore, a cooler of air or mist is arranged between the cooling roll and the pinch roll so as to provide a proper cooling rate and an adequate entrance side temperature for the pinch rolls 16, 16'.

The effect by gas or mist (or fog) cooling is described below.

Figure 4:
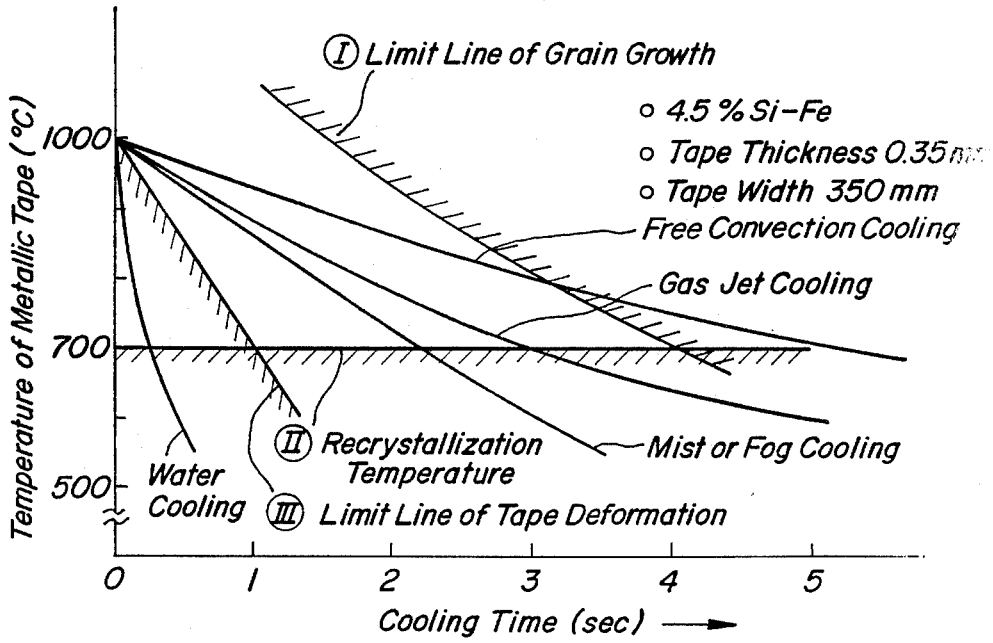
FIG. 4 is a graph showing an adequate cooling curve.

Such a secondary cooling aims at the insurance of (I) a secondary cooling rate not breaking the rapidly solidified texture, (II) a coiling temperature not breaking the rapidly solidified texture and (III) a cooling rate not breaking the form of high temperature metallic tape. The limit lines of such purposes I, II and III are represented by shadowed lines in FIG. 4 when they are plotted on a curve of tape temperature-cooling time in the metallic tape of 4.5% Si-Fe alloy having a width of 350 mm and a thickness of 0.35 mm. Therefore, in order to achieve the above purposes, it is necessary to locate the secondary cooling rate inside a region defined by these shadowed lines. As a result of experiments for the metallic tape of 4.5% Si-Fe alloy having a thickness of 0.35 mm and a width of 350 mm, it has been confirmed that the secondary cooling rate is 1500° C./sec in the water cooling, 200° C./sec in the mist or fog cooling, 100° C./sec in the gas jet cooling, and 60° C./sec in the free convection cooling. Thus, it has been concluded that the cooling rate capable of enough entering into the adequate cooling zone of FIG. 4 is attained by any one of the mist, fog and gas jet coolings.

In this connection, a rapidly solidified metallic tape of 4.5% Si-Fe alloy having a width of 350 mm and a thickness of 0.4 mm was produced by a twin-roll process, which was cooled by means of a cooling apparatus of water, mist (fog) or gas jet just beneath the roll and continuously coiled to obtain results as shown in the following Table 3.

TABLE 3

| | Water cooling | Mist cooling | Gas jet cooling | Free convection cooling |
|---|---|---|---|---|
| Temperature at delivery side of cooling roll | 1200° C. | | | |
| Average cooling rate (1200° C.→700° C.) | 1250° C./sec | 170° C./sec | 120° C./sec | 55° C./sec |
| Coiling temperature | 175° C. | 420° C. | 620° C. | 820° C. |
| Grain growth | none | none | none | presence |
| Tape deformation | presence | none | none | none |
| Total evaluation | x | | | x |

Figure 5A:
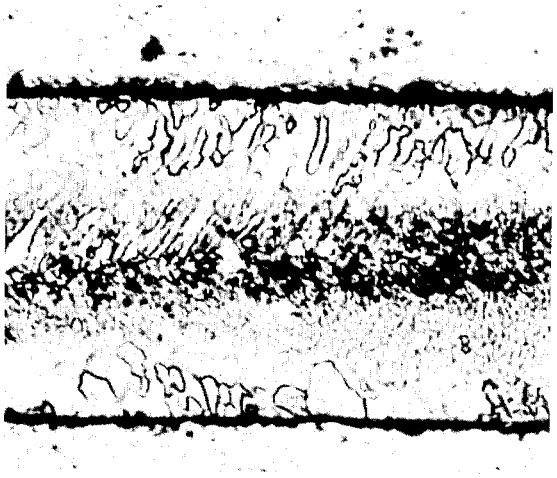
FIGS. 5*a* and 5*b* are metal microphotographs showing the absence and presence of grain growth in the rapidly solidified textures, respectively.
Figure 5B:
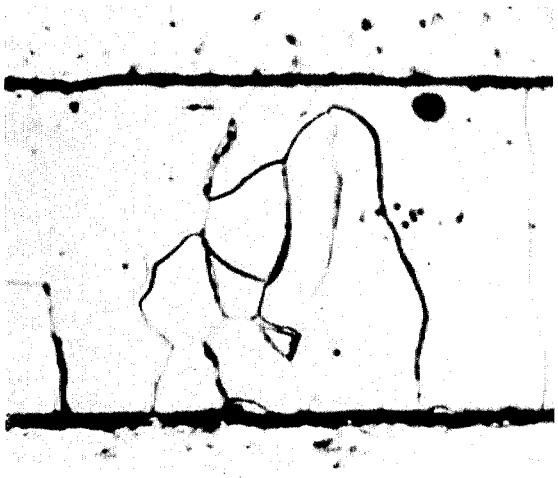

(Note)
The average cooling rate is a cooling rate between tape temperature just beneath the roll (1200° C.) and 700° C. The coiling temperature is a temperature value after 5 seconds of the secondary cooling time. The presence or absence of grain growth is made according to a microscope investigation shown in FIG. 5. wherein FIG. 5a is a micrograph showing no grain growth and FIG. 5b is a micrograph showing grain growth. The tape deformation is based on a flatness of not less than 3/1000.

After the secondary cooling, the metallic tape is rolled through pinch rolls 16, 16' to correct the texture (microcrystalline texture) and form of the tape. In this case, a better result is obtained by the different speed operation of the pinch rolls 16, 16'. According to the invention, there is a difference in peripheral speed between pinch rolls 16 and 16'. This is termed "different speed rolling", which means that the rolling is between a pair of rolls (such as 16 and 16') having a predetermined speed difference therebetween.

The different speed rolling through the pinch rolls 16, 16' was made, after the rapidly solidified metallic tape of 4.5% Si-Fe alloy having a width of 350 mm and a thickness of 0.35 mm was produced by the twin-roll process and cooled with gas jet as a secondary cooling stage, to obtain results as shown in the following Table 4.

TABLE 4

| | equal speed | different speed |
|---|---|---|
| Rolling temperature | 720° C. | |
| Ratio of different speeds | 1.0 | 1.05 |
| Entrance side tension | 0.5 kg/mm$^2$ | 0.5 kg/mm$^2$ |
| Delivery side (coiling) tension | 1.0 kg/mm$^2$ | 1.0 kg/mm$^2$ |
| Rolling force | 700 kg | 700 kg |
| Entrance side crown | ±20 μm | |
| Delivery side crown | ±18 μm | ±15 μm |
| Entrance side flatness | $\frac{2}{1000}$ | |
| Delivery side flatness | $\frac{2}{1000}$ | $\frac{1}{1000}$ |
| Descaling effect | none | presence |
| Edge cracking | occurred | not occur |

The effect of the different speed rolling is as follows.

The different speed rolling aims at (a) reduction of tape form (crown), (b) reduction of flatness, (c) descaling and (d) improvement of texture. If it is intended to achieve these purposes (a)–(d) by the usual rolling (at equal speed), high rolling force is required, resulting in the occurrence of problems such as edge cracking and the like. On the other hand, the expected effects are achieved by the different speed rolling at a low rolling force.

As to the tension of the metallic tape, it is necessary to make the tension for the metallic tape as low as possible in order to prevent the breakage of the tape, while it is necessary in the coiling machine to make the tension high in order to obtain sufficiently good tape form and coiling form. On the other hand, since the metallic tape has such a fairly rapid temperature gradient in the direction of production line that the temperature just beneath the cooling roll is 1200° C. at maximum and the coiling temperature is about 500° C., the tensile strength of the metallic tape changes from 0.1 kg/mm$^2$ to 8 kg/mm$^2$ in case of 4.5% Si-Fe alloy.

In order to solve the above problem on the tension, therefore, the tension control is separately carried out at a region between the cooling roll 3, 3' and the pinch roll 16, 16' and a region between the pinch roll 16, 16' and the take-up reel 20. Of course, the caternary control is performed at a low tension of about 0.1 kg/mm$^2$ in the front region, while the coiling is performed at a high tension of about 1 kg/mm$^2$ in the rear region.

Figure 6:
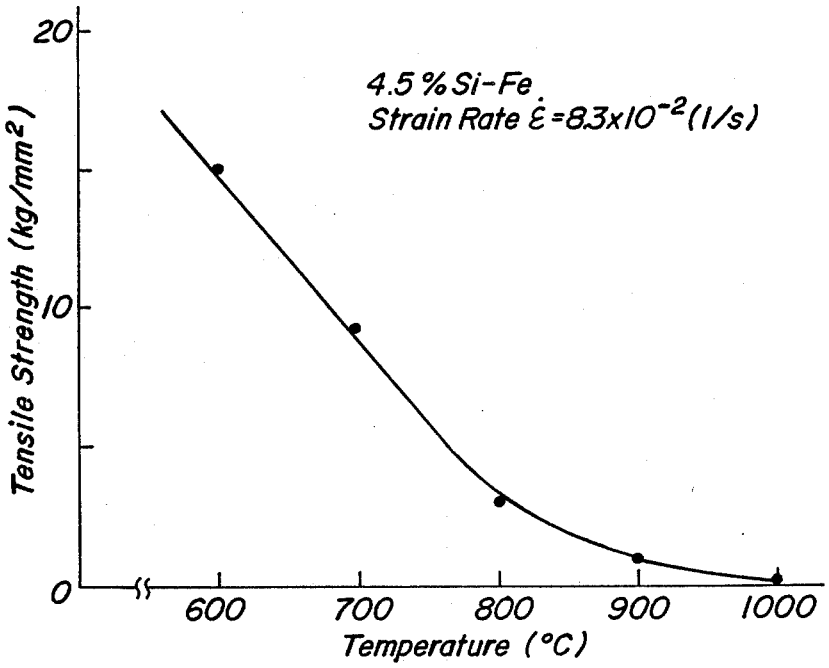
FIG. 6 is a graph showing a temperature dependency of tensile strength in the metallic tape.

FIG. 6 is a graph showing the temperature dependency of tensile strength in the metallic tape of 4.5% Si-Fe alloy. Viewing from the coiling conditions, the coiled form is good in the coiling under a high tension. However, since the temperature of the metallic tape just beneath the coiling roll is above 1000° C., the tensile strength at a temperature above 1000° C. is not more than 0.5 kg/mm$^2$ as apparent from FIG. 6, so that such a metallic taps is broken when coiling at a unit tension of not less than 1 kg/mm$^2$ usually used in the coiling machine.

Therefore, after the tensile strength of the metallic tape is increased to a certain extent by arranging the pinch rolls 16, 16' behind the cooling zones 12, 12', the high tension is applied to the metallic tape. That is, the separate tension control as mentioned above is performed in such a manner that the front region (from the cooling rolls 3, 3' to the pinch rolls 16, 16') is substantially the catenary control at low tension and the rear region (from the pinch rolls 16, 16' to the take-up reel 20) is the coiling at high tension.

The effect by the separate tension control is shown in the following Table 5.

TABLE 5

| | | | |
|---|---|---|---|
| Separate control | performed | not performed | not performed |
| Tension at front region | 0.3 kg/mm$^2$ | 0.3 kg/mm$^2$ | 1.2 kg/mm$^2$ |
| Tension at rear region | 1.7 kg/mm$^2$ | 0.3 kg/mm$^2$ | 1.2 kg/mm$^2$ |
| Results | good coiled form no breakage | bad coiled form no breakage | — breakage |

Figure 7:
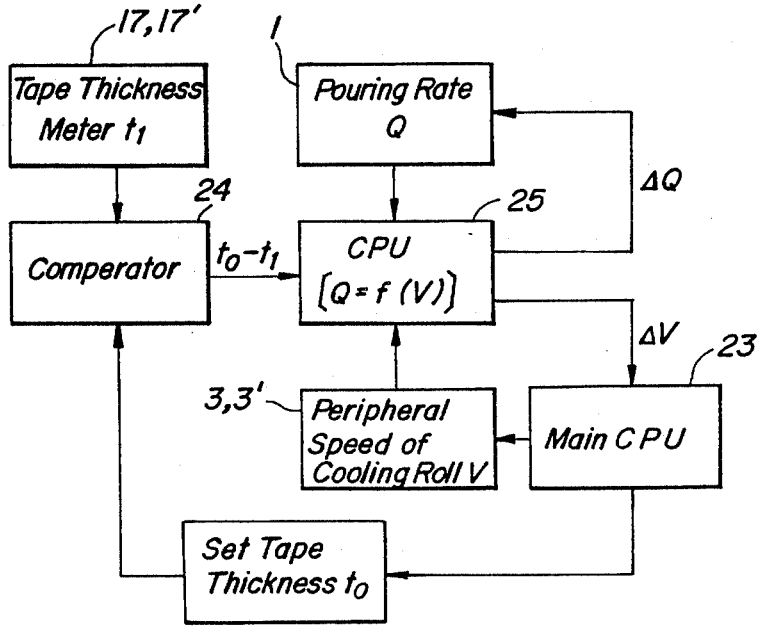
FIG. 7 is a circuit diagram for controlling the pouring rate of molten metal.

In FIG. 7 is shown an embodiment of the pouring rate control circuit in the apparatus for producing the rapidly solidified microcrystalline metallic tape described on FIG. 1. In this case, the above apparatus is operated under the peripheral speed V of the cooling rolls 3, 3' and the set tape thickness to established in a main CPU 23, during which an output signal $t_1$ detected by the tape thickness meter 17, 17' is compared with the set tape thickness $t_0$ in a comparator 24. A tolerance signal $t_0$–$t_1$ from the comparator 24 is fed to a CPU 25, at where the control $\Delta Q$ for increasing or decreasing the pouring rate Q of the pouring nozzle 1 is carried out according to the relation of $Q=f(V)$ and a signal $\Delta V$ for increasing or decreasing the peripheral speed V of the cooling roll in accordance with the control $\Delta Q$ is fed to the main CPU 23.

Moreover, it is a matter of course that the reduction of the travelling line speed in the cutting of non-steady tape portion at the initial and last production stages is previously programmed in the main CPU 23.

The following example is given in illustration of the invention and is nof intended as limitation thereof.

EXAMPLE

A rapidly solidified microcrystalline metallic tape was produced under the following experimental conditions to obtain the following experimental results.

| | |
|---|---|
| [Experimental Conditions] | |
| Composition: | 4.5% Si—Fe |
| Tape form: | 0.35 mm thickness × 200 mm width × 1000 m length |
| Heat size: | 500 kg |
| Steady pouring rate: | 3 kg/sec |
| Equation for pouring rate control at a time of increasing or decreasing speed: | |
| $Q(kg/sec) = a \cdot V^{0.5}(m/sec) + b \cdot V(m/sec)$ | |
| $a = 0.07\left(\frac{kg}{sec^{0.5} \cdot m^{0.5}}\right)$ | |
| $b = 0.4$ (kg/sec) | |
| Peripheral speed of cooling roll: | 3 m/sec at sledding and last tape travelling<br>7 m/sec at steady pouring |
| Rate of increasing or decreasing speed: | 0.5 m/sec$^2$ (time: 8 sec) |
| Cooling medium: | air |
| Air flow rate: | 0.19 Nm$^3$/sec |
| Cooling zone length: | 10 m |
| Tension control: | front region 0.1 kg/mm$^2$<br>rear region 1 kg/mm$^2$ |
| Rolling force of pinch roll: | 300 kg |
| Ratio of different speeds in pinch rolls: | VH/VL = 1.03 |
| [Experimental Results] | |
| Cut length of non-steady portion: | 10 m front end<br>15 m rear end |
| Temperature at delivery side of cooling roll: | 1100° C. |
| Temperature at entrance side of pinch roll: | 700° C. |
| Temperature at entrance side of coiling machine: | 650° C. |
| Cooling rate: | 200° C./sec between cooling roll and pinch roll<br>50° C./sec between pinch roll and take-up reel |
| Tape form: | ±15 μm before pinch roll<br>±10 μm after pinch roll (in case of releasing the rolling force at the passing of rear end) |
| Flatness: | 1/1000 mm after coiling |
| Variation of tape thickness at the time of increasing or decreasing speed: | ±3% (to steady tape thickness of 350 μm) |

VH/VL=1.03 means that a ratio of a higher peripheral speed VH of pinch roll 16, to a lower peripheral speed VL of pinch roll 16' is 1.03.

As mentioned above, according to the invention, the coiling can be performed without degrading the form of the rapidly solidified microcrystalline metallic tape, and the handling of the tape can considerably be simplified. Further, the apparatus according to the invention is suitable for practicing the above method.

What is claimed is:

1. A method of producing a rapidly solidified microcrystalline metallic tape by continuously pouring molten metal through a nozzle onto surfaces of a pair of cooling members rotating at a high speed to rapidly solidify it and then coiling the resulting rapidly solidified metallic tape, characterized by the steps of initially cutting an imperfect portion of the solidified tape with a cutting means installed in a vertical path just beneath said cooling rolls, catching a steady tip of the cut tape and transporting the tape through a cooling region, and coiling said tape into a roll.

2. The method according to claim 1, wherein a travelling line speed of said metallic tape is decreased at said initial production stage including a last production stage in the cutting of said non-steady portion, and increased at the remaining steady stage.

3. The method according to claim 1, including a first and second rolling surface, and the step of increasing the speed of the first rolling surface with respect to the second rolling surface.

4. The method according to claim 1, wherein said cooling of the metallic tape is carried out with gas or mist or fog.

5. The method according to claim 1, wherein tension control of said metallic tape while being transported from the cooling members to coiling is separately carried out at a front region wherein said metallic tape is at low tension, and a rear region wherein said metallic tape is at high tension.

* * * * *